US005548657A

United States Patent [19]

Fincham

[11] Patent Number: 5,548,657

[45] Date of Patent: Aug. 20, 1996

[54] COMPOUND LOUDSPEAKER DRIVE UNIT

[75] Inventor: Lawrence R. Fincham, Tenterden, United Kingdom

[73] Assignee: KEF Audio (UK) Limited, Maidstone, England

[21] Appl. No.: 291,721

[22] Filed: Aug. 16, 1994

Related U.S. Application Data

[63] Continuation of Ser. No. 970,542, Nov. 2, 1992, abandoned, which is a continuation of Ser. No. 870,231, Apr. 20, 1992, abandoned, which is a continuation of Ser. No. 603,679, Nov. 2, 1990, abandoned.

[30] Foreign Application Priority Data

May 9, 1988 [GB] United Kingdom ..... 8810943

[51] Int. Cl.[6] ..... H04R 25/00

[52] U.S. Cl. ..... 381/182; 381/205

[58] Field of Search ..... 381/182, 99, 204, 381/195, 192, 194; 181/144, 199

[56] References Cited

U.S. PATENT DOCUMENTS

| | | | |
|---|---|---|---|
| 3,917,914 | 11/1975 | Parker | 381/204 |
| 4,465,905 | 8/1984 | Nation . | |
| 4,492,826 | 1/1985 | Chiu | 381/86 |
| 4,552,242 | 11/1985 | Kashiwabara . | |
| 4,590,333 | 5/1986 | Strohbeen | 381/182 |
| 4,685,448 | 12/1987 | Shames | 381/169 |
| 4,811,406 | 3/1989 | Kawachi | 381/182 |

FOREIGN PATENT DOCUMENTS

| | | | |
|---|---|---|---|
| 0230639 | 8/1987 | European Pat. Off. . | |
| 1001734 | 2/1952 | France . | |
| 3007115 | 9/1981 | Germany | 381/186 |
| 2-287397 | 11/1990 | Japan . | |
| 665815 | 1/1952 | United Kingdom . | |
| 2153628 | 8/1985 | United Kingdom . | |

OTHER PUBLICATIONS

"Ccomposite Speaker"—Tanaka, *JP Abstracts* Jan. 1985.

*Primary Examiner*—Curtis Kuntz
*Assistant Examiner*—Sinh Tran
*Attorney, Agent, or Firm*—Donald S. Dowden

[57] ABSTRACT

A compound loudspeaker drive unit comprises a low frequency unit having an outwardly and forwardly flaring conical diaphragm and a high frequency drive unit located in or adjacent to the neck of the low frequency conical diaphragm such that the acoustic centers of the two units are substantially coincident and, for a cross-over frequency range in which both drive units contribute significant sound output, the directivity of sound radiation from the high frequency unit as acoustically loaded by the low frequency conical diaphragm is substantially the same as that of the low frequency unit. A magnet structure for the high frequency unit utilises a magnet formed of neodymium iron boron which enables the high frequency unit to be positioned within a drive coil for the low frequency diaphragm while providing a required high value of magnetic flux.

4 Claims, 1 Drawing Sheet

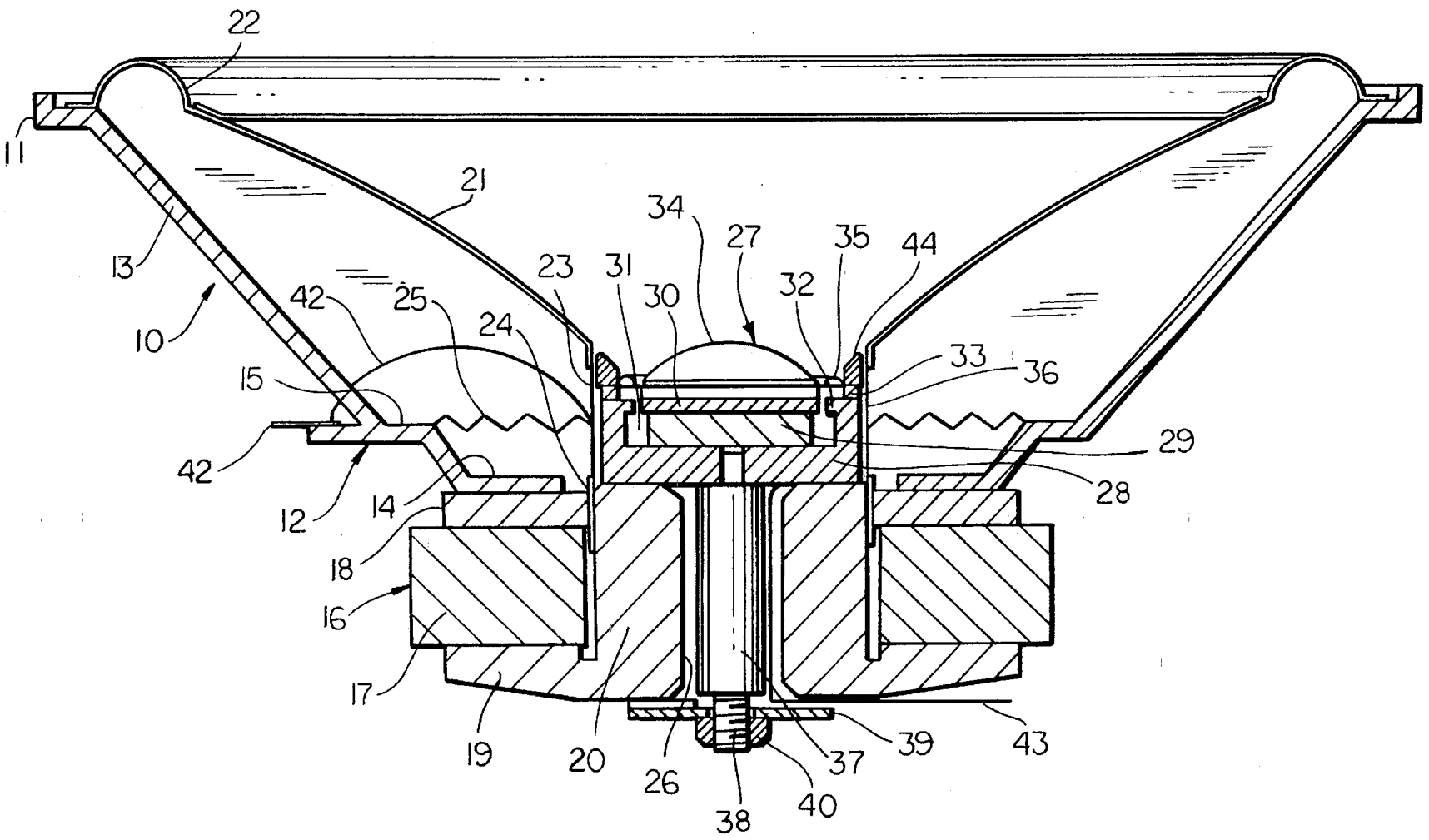
29
28
36
33
44
35
32
27
34
30
31
23
24
25
42
15
42
12
14
18
16
17
19
20
26
38
40
37
39
43
22
21
13
10
11

COMPOUND LOUDSPEAKER DRIVE UNIT

This application is a continuation of application Ser. No. 970,542 filed Nov. 2, 1992 now abandoned which is a continuation of application Ser. No. 870,231, filed Apr. 20, 1992, now abandoned, which is a continuation of application Ser. No. 07/603,679, filed Nov. 2, 1990, now abandoned.

This invention relates to loudspeakers and in particular to compound loudspeaker drive units in which separate diaphragms are provided for reproduction of the low and high audio frequencies.

In some known loudspeaker systems, separate loudspeaker drive units are provided for reproduction of bands of audio frequencies, for example a woofer unit for reproduction of sounds in a low frequency band and a tweeter unit for reproduction of sounds in a high frequency band. The voice coils of the loudspeaker drive units are connected to the output of a power amplifier, or other source, through a suitable cross-over filter network which ensures that only electrical signals representing sounds in the appropriate bands are applied to the individual loudspeaker voice coils. The characteristic of the cross-over filter is arranged so that in a mid frequency cross-over band intermediate the low and high frequency bands the outputs of the two loudspeaker drive units tail off; the output of the low frequency loudspeaker drive unit reduces with increase of frequency while the output of the high frequency loudspeaker drive unit reduces with decrease in frequency. At a so-called crossover frequency the low and high frequency loudspeaker drive units have outputs which are equal but reduced in comparison with their outputs within their respective frequency bands. The electrical energisations of the respective voice coils are adjusted so that the sound outputs of the loudspeaker drive units are relatively matched and together provide a substantially uniform output over the total frequency range of the combination of the two loudspeaker drive units. The sound radiated from each of the drive units may be said to emanate from the apparent sound source or acoustic center of that unit; the position of the acoustic center is a function of the design of the particular unit and may be determined by acoustic measurement.

When separate loudspeaker drive units are provided, the apparent sound sources are physically offset from one another. The loudspeaker drive units are usually mounted on a common baffle such that they lie in a common plane and are offset in a vertical direction in the plane of the baffle. For a listener positioned approximately in line with the axes of the loudspeaker drive units and approximately equidistant from the acoustic centers of both drive units, a desired balance of output from the two drive units can be obtained. However if the position of the listener is moved from the equidistant position, the distances between the listener and the acoustic centers of the two loudspeaker drive units will be different and hence sounds in the mid frequency band produced by both loudspeakers will be received by the listener from the two drive units with a difference in time. This time difference between sounds received from the two drive units results in a change in phase relationship of the sounds received at the listening position from the two drive units. The sounds from the two drive units no longer add together as intended in the cross-over band. Consequently the resultant received sound levels will vary with frequency and the overall sound output of the loudspeaker combination will appear to the listener to be non-uniform. The resulting raggedness in sound output colours the sound and, with stereo sound systems, there is a loss of clarity in the apparent location of instruments in the sound stage. This is particularly apparent in respect of sound frequencies in the upper mid-range, for example in the region of 3 kHz, at which the offset of the drive units relative to one another is comparable to the wavelength of the sound. At a frequency of 3 kHz the wavelength is approximately 4 inches or 100 cm.

In an attempt to overcome the undesirable effects on sounds received at positions which are not equidistant from the two loudspeaker drive units, it is known to combine the low and high frequency loudspeaker drive units in a single compound co-axial construction. The compound co-axial loudspeaker drive unit consists of a generally conical low frequency diaphragm driven by a voice coil interacting with a magnetic structure having a central pole extending through the voice coil. A high frequency diaphragm is positioned to the rear of the structure and sound output from this diaphragm is directed to the front of the loudspeaker drive unit by means of a horn structure extending co-axially through the center pole of the magnetic structure which interacts with the low frequency diaphragm. Thus both the low frequency and high frequency sounds are directed in a generally forward direction from the compound loudspeaker drive unit. In this co-axial form of loudspeaker construction there is no vertical or horizontal offset of the apparent sound sources for low and high frequencies. However the low frequency diaphragm is positioned at the front of the loudspeaker unit whereas the high frequency diaphragm is positioned at the rear of the loudspeaker unit and this results in relative displacement of the apparent sound sources in the direction of the axis of the drive unit and an undesirable time difference in the arrival, at the listener, of sounds from the high and low frequency diaphragms.

SUMMARY OF THE INVENTION

According to one aspect of the invention a compound loudspeaker drive unit comprises a first transducer operable to generate sounds in a low frequency range and a second transducer operable to generate sounds in a high frequency range, said low and high frequency ranges overlapping in a cross-over region; said first transducer having a conical diaphragm flaring outwardly and forwardly from a neck; said second transducer being located in or adjacent to the neck of the conical diaphragm of the first transducer in such a position that effective acoustic centers of the first and second transducers are coincident and that in the cross-over region the flaring of the conical diaphragm imposes a directivity upon the radiation of sound from the second transducer whereby the directivities of the first and second transducers are matched over frequencies in the cross-over region where both transducers make significant contributions to the sound output of the drive unit.

According to a second aspect of the invention a compound loudspeaker drive unit comprises a low frequency moving coil drive unit and a high frequency moving coil drive unit; said high frequency drive unit including magnetic means interacting with the moving coil thereof, said magnetic means including a permanent magnet formed of neodymium iron boron or of material having magnetic properties substantially similar or superior thereto.

Preferably the compound loudspeaker drive unit includes a low frequency drive unit comprising a substantially frusto-conical low frequency diaphragm flaring outwardly in a forward direction from a neck thereof, a low frequency voice coil connected to said neck of the diaphragm; and first magnetic means providing a magnetic flux interacting with the low frequency voice coil whereby electrical energisation of the voice coil is effective to impart movement to the diaphragm to produce sounds in a low frequency range; and a high frequency loudspeaker drive unit positioned adjacent to said neck of the low frequency diaphragm and comprising a high frequency diaphragm carrying a high frequency voice coil; and second magnetic means including a permanent magnet formed of neodymium iron boron, or of a material having magnetic properties substantially similar or superior thereto, providing a magnetic flux interacting with the high frequency voice coil whereby electrical energisation of the high frequency voice coil is effective to impart movement to the high frequency diaphragm to produce sounds in a high frequency range overlapping the low frequency range in a cross-over band.

Preferably the high frequency drive unit is disposed relative to the low frequency drive unit such that the apparent sound sources of the two units are substantially coincident.

If desired an annular baffle member may be provided effective to provide a continuation of the surface of the low frequency diaphragm toward the high frequency diaphragm.

According to a third aspect of the invention in a loudspeaker comprising co-axially disposed low and high frequency drive units the high frequency drive unit is manufactured separately from said low frequency drive unit and is secured to a pole piece of magnetic means of the low frequency drive unit.

Preferably the pole piece of the low frequency drive unit has a central bore extending therethrough and the high frequency drive unit has a rod, preferably of non-magnetic material, projecting therefrom and engaging within said bore to locate the high frequency drive unit relative to the low frequency drive unit.

BRIEF DESCRIPTION OF THE DRAWING

An embodiment of the invention will now be described by way of example with reference to the drawing which shows a cross section through the axis of a moving coil compound loudspeaker drive unit.

DESCRIPTION OF THE PREFERRED EMBODIMENT

Referring to the drawing, a compound loudspeaker drive unit with low frequency and high frequency transducers having co-axial low and high frequency voice coils comprises a chassis 10 in the form of a conical basket having a front annular rim 11 connected to a rear annular member 12 by means of a number of ribs 13. The rear annular member 12 has an annular flange 14 and an annular seat 15. Secured to the flange 14 is a first magnetic structure 16 for the low frequency loudspeaker drive unit. The magnetic structure 16 comprises a magnet ring 17, which may for example be formed of barium ferrite, a front annular plate 18 which forms an outer pole and a member 45 which forms a backplate 19 and an inner pole 20. The plate 18, magnet ring 17 and member 45 are held together to provide a magnetic path interrupted by a non-magnetic air gap between the 18 formed by plate and the inner pole 20. The poles are circular and form therebetween an annular air gap. The low frequency transducer or loudspeaker drive unit comprises a diaphragm 21 of generally frusto-conical form supported along the front outer edge thereof by a flexible surround 22 secured to the front rim 11 of the chassis 10. A tubular coil former 23 is secured to the rear edge of the diaphragm 21 and is arranged to extend co-axially of the air gap in the magnetic structure 16. The coil former carries a voice coil 24 positioned on the former such that the coil extends through the air gap. The coil is of sufficient axial length as to ensure that for normal excursions of the voice coil, the poles always lie within the length of the voice coil. A suspension member 25, in the form of a spider consisting of inner and outer rings interconnected by flexible legs or consisting of a corrugated sheet having annular corrugations, is secured between the coil former 23 and the annular seat 15 of the chassis 10 in order to ensure that the coil former, and voice coil carried thereby, are maintained concentric with the poles of the magnetic structure and out of physical contact with the poles during sound producing excursions of the diaphragm 21. The member 45 forming the backplate 19 and inner pole has a bore 26 extending co-axially thereof for the purpose of mounting a high frequency drive unit 27.

The high frequency transducer or drive unit 27 comprises a second magnetic structure consisting of a pot 28, a disc shaped magnet 29 and a disc shaped inner pole 30. The pot 28 has a cylindrical outer surface so dimensioned as to fit within the interior of the coil former 23 without making physical contact therewith. The pot is formed with a circular recess 31 to receive the magnet 29 and an annular lip 32 to form an outer pole. One circular pole face of the magnet 29 is held in engagement with the bottom wall of the recess 31 and the disc shaped inner pole 30 is held in engagement with the other circular pole face of the magnet such that the circular outer periphery of the inner pole 30 lies co-axially with and within the lip 22 forming the outer pole. A non-magnetic air gap extends between the inner and outer poles. A spacer ring 33 is secured to the front face of the pot 28. Preferably the magnet 29 is formed of neodymium iron boron which allows a very substantially enhanced magnetic field strength as compared with other available magnetic materials to be attained in the air gap between the poles. As a result, the overall size of the high frequency magnetic structure, for a required flux in the air gap, can be smaller than hitherto thereby allowing the high frequency drive unit to be positioned within the coil former of the low frequency drive unit immediately adjacent to the apex of the low frequency diaphragm 21. However it will be appreciated that the magnet 29 may be formed of other materials having magnetic properties substantially similar or superior to that of neodymium iron boron. A high frequency domed diaphragm 34 has an annular support 35 of annular corrugated form and this support is secured at its outer periphery to the spacer ring 33. Secured to the domed diaphragm 34 is a cylindrical coil former carrying a high frequency voice coil 36 such that the voice coil extends through the air gap between the poles 30, 32 of the magnetic structure.

In order to centralise the high frequency unit relative to the low frequency unit, and in particular to ensure that the high frequency unit is coaxial with and does not interfere with motion of the low frequency voice coil a rod 37, preferably of non-magnetic material, is secured centrally to the rear face of the pot 28 and extends through the bore 26 of the low frequency magnetic structure. The high frequency drive unit tends to be held in engagement with the pole 20 of the magnetic structure 16 by magnetic attraction therebetween but is secured to the structure 16 by a threaded end portion 38 of the rod 37 extending through an aperture in a plate 39 positioned at the rear of the backplate 19 and a nut 40 threaded onto the end portion 38.

Connections to the low frequency voice coil 24 are provided by means of flexible leadout conductors 41 extending from the voice coil 24 to external connectors 42. Connections to the high frequency voice coil 36 are provided by flexible conductors 43 which extend along a recess in the outer wall of the pot 28, between the pot 28 and the inner pole 20 and thence through the bore 26 to external connectors (not shown). In order to allow the conductors to extend through the bore 26, the rod 37 has a diameter smaller than that of the bore 26 so as to leave an annular space through which the conductors 43 extend. Means, not shown, are provided between the pole piece 20 and the pot 28 to ensure that the rod lies co-axially with the bore 26. This means may be a disc secured to the pole piece 20 and having a central aperture of a diameter to receive the rod 37 in a sliding fit. The disc may be grooved to provide a passageway for the conductors 43 between the pole piece 20 and the pot 28. The rod 37 may be of circular, hexagonal or other section and the disc would be provided with a central aperture of matching shape.

Instead of utilising a rod 37 of diameter smaller than that of the bore 26, if the rod is of hexagonal section its diameter may be of a size such that the rod is a sliding fit in the bore 26 to locate the high frequency drive unit co-axially of the pole piece 20 of the low frequency drive unit. Spaces between the faces of the hexagonal section rod and the wall of the bore 26 provide passageways for the conductors 43. Instead of using a plate 39 to secure the high frequency drive unit, a moulding may be used. The moulding would be located by means of a boss on the moulding entering the bore 26. The moulding may be so formed as to provide a mounting for other components such as the electronic components of a cross-over filter and terminals for electrical drive signals for the compound loudspeaker drive unit. As an alternative to the end 38 of the rod 37 being externally threaded, the end of the rod may be bored and threaded internally to receive a screw.

The construction described hereinbefore is particularly convenient in manufacture of the compound loudspeaker drive unit in that the high frequency drive unit is centralised relative to the low frequency drive unit prior to the high frequency drive unit reaching its final rest position on the pole piece 20. As a result the high frequency unit is prevented from engaging the low frequency voice coil during assembly of the compound loudspeaker drive unit. Furthermore this construction facilitates dis-assembly of the high frequency drive unit from the low frequency drive unit if and when any servicing of the units is necessitated without any need to demagnetise either of the magnetic assemblies.

If desired, an annular baffle 44 having a frusto-conical front surface is secured to the front of the high frequency drive unit to provide a continuation of the surface of the low frequency diaphragm 21 towards the domed high frequency diaphragm.

It will be appreciated that with the high frequency drive unit positioned at or adjacent to the neck of the diaphragm of the low frequency drive unit, as in the above described construction of compound loudspeaker drive unit, the apparent sound source or acoustic center of the high frequency drive unit is substantially co-incident with the apparent sound source or acoustic center of the low frequency drive unit. The radiation pattern or directivity of the low frequency drive unit is determined inter alia by the form of the low frequency diaphragm. With the high frequency drive unit positioned adjacent to the neck of the low frequency diaphragm, the form of the low frequency diaphragm imposes its directivity upon the radiation pattern or directivity of the high frequency unit. Consequently at frequencies at which both drive units contribute significant sound output, both drive units have substantially similar patterns of radiation or directivity. As a result the relative sound contributions from the two drive units as perceived by a listener are substantially unaffected by the listener being positioned at off axis positions.

The low frequency conical diaphragm is shown in the drawing as being of conical form having an angle of flare which increases from the neck of the diaphragm toward the outer periphery of the diaphragm. However it will be appreciated that the diaphragm may be of conical form having a uniform angle of flare. Also, the low frequency conical diaphragm may be of circular, elliptical or other section as desired.

The high frequency diaphragm is shown in the drawing as being of domed form. Such a diaphragm is suitable because its acoustic center may readily be located in close coincidence with that of the low frequency diaphragm, and because, in the frequency range where both drive units contribute significant sound output, its small size relative to wavelength gives it, by itself, essentially non-directional sound radiation, allowing the effective directivity to be determined by the low frequency diaphragm. It will be appreciated that the high frequency diaphragm may alternatively be of any other form that provides these characteristics.

I claim:

1. A compound loudspeaker drive unit including a low frequency conical diaphragm flaring outwardly and forwardly from a neck of said low frequency conical diaphragm to generate sound output in a low frequency range, said low frequency conical diaphragm having a first effective acoustic center and having a first directivity;

a high frequency diaphragm of domed form to generate sound output in a high frequency range, said high frequency diaphragm having a second effective acoustic center;

said low frequency range of sound and said high frequency range of sound overlapping in a cross-over region and both said low frequency conical diaphragm and said high frequency diaphragm being effective to make significant contributions to sound output in said cross over region;

said low frequency conical diaphragm and said high frequency diaphragm being located coaxially and said high frequency diaphragm being located adjacent said neck of said low frequency diaphragm so that said second effective acoustic center of said high frequency diaphragm is substantially coincident with said first effective acoustic center of said low frequency conical diaphragm and in said cross-over region where both said low frequency conical diaphragm and said high frequency diaphragm make significant contributions to the sound output the flaring of said low frequency conical diaphragm being effective to impose said first directivity upon said high frequency diaphragm so that said sound output from said high frequency diaphragm has a directivity matched to said first directivity of sound output from said low frequency conical diaphragm;

first magnetic means including a first magnetic flux path provided by a first central pole piece and a first outer pole piece extending around said first central pole piece with a first air gap between said first central pole piece and said first outer pole piece; and a first magnet to generate a first magnetic flux in said first flux path;

a cylindrical voice coil former secured to said neck of said low frequency conical diaphragm and extending rearwardly from said neck, said coil former including a first portion secured to the neck and a second portion extending rearwardly from said first portion in said first air gap and a first voice coil carried by said second portion of said cylindrical voice coil former, said first voice coil being located in said first air gap and electromagnetically coupled with said first magnetic flux;

second magnetic means including a second magnetic flux path provided by a second central pole piece and a second outer pole piece with a second air gap therebetween; said second outer pole piece being mounted on said first central pole piece and being located within said first portion of said coil former; said first magnetic flux path being separable from said second magnetic flux path; and a second magnet of neodymium iron boron compound to generate a second magnetic flux in said second flux path and said second air gap; and a second voice coil secured to a peripheral edge of the domed high frequency diaphragm and extending in said second air gap and electromagnetically coupled with said second magnetic flux.

2. The compound loudspeaker drive unit as claimed in claim 1 wherein the low frequency diaphragm flares outwardly with a progressively increasing angle of flare from the neck to a front peripheral edge of said low frequency conical diaphragm.

3. A compound loudspeaker drive unit including a low frequency conical diaphragm flaring outwardly and forwardly from a neck of said low frequency conical diaphragm to generate sounds in a low frequency range, said low frequency conical diaphragm having an effective first acoustic center; a cylindrical voice coil former secured to said neck of said low frequency conical diaphragm and a first voice coil carried by said cylindrical voice coil former;

a high frequency diaphragm of domed form to generate sounds in a high frequency range, said high frequency diaphragm having an effective second acoustic center; a second voice coil secured to a peripheral edge of said high frequency diaphragm; and magnetic means including first and second air gaps in which said first and second voice coils respectively extend, said magnetic means producing a first magnetic flux in said first air gap interacting with said first voice coil and a second magnetic flux in said second air gap interacting with said second voice coil;

said magnetic means comprising a first magnetic structure including a first permanent magnet producing said first magnetic flux in a first magnetic flux path in said first magnetic structure and in said first air gap; and a second magnetic structure including a second permanent magnet producing said second magnetic flux in a second magnetic flux path in said second magnetic structure and in said second air gap, said second magnetic flux path being separable from said first magnetic flux path;

and said second permanent magnet being formed of a neodymium iron boron compound so that for a required magnitude of magnetic flux in said second air gap said second magnetic structure is of sufficiently small size to be accommodated within said voice coil former, said high frequency diaphragm being located with said peripheral edge thereof aligned rearwardly of the neck of said low frequency diaphragm and with said effective first acoustic center coincident with said effective second acoustic center, respectively, and the flaring of said low frequency conical diaphragm establishing a directivity of said low frequency diaphragm which is imposed on said high frequency diaphragm to cause said low frequency diaphragm and said high frequency diaphragm to have directivities that are matched over frequencies in the cross-over region where both said low frequency conical diaphragm and said high frequency diaphragm make significant contributions to the sound output of the drive unit;

wherein the first magnetic structure and low frequency conical diaphragm comprises a first manufactured unit in which said first magnetic structure includes a central pole piece having a bore extending centrally therethrough; and the second magnet structure and the high frequency diaphragm comprises a second manufactured unit separate from said first manufactured unit and including a rod extending rearwardly from said second magnetic structure; said rod extending through said bore and being effective to locate said second manufactured unit relative to said first manufactured unit.

4. The compound loudspeaker drive unit as claimed in claim 3 wherein a wall of the bore in the central pole piece and the rod extending therethrough define a passage and including conductors providing electrical connections to the second voice coil and wherein said conductors extend through said passage.

* * * * *